US007360834B2

(12) United States Patent
Miller et al.

(10) Patent No.: US 7,360,834 B2
(45) Date of Patent: Apr. 22, 2008

(54) REVERSIBLE SLIPCOVER

(75) Inventors: Brenda Kay Miller, Jersey Shore, PA (US); Roseann Clarke, Maplewood, NJ (US)

(73) Assignee: Sure Fit Inc., Allentown, PA (US)

( * ) Notice: Subject to any disclaimer, the term of this patent is extended or adjusted under 35 U.S.C. 154(b) by 0 days.

(21) Appl. No.: 11/341,796

(22) Filed: Jan. 27, 2006

(65) Prior Publication Data

US 2007/0176474 A1 Aug. 2, 2007

(51) Int. Cl.
*A47C 31/11* (2006.01)

(52) U.S. Cl. ..... 297/225; 297/224; 297/228; 297/228.11; 297/228.12; 297/228.13; 297/229

(58) Field of Classification Search ..... 29/225, 29/223, 228, 229, 224; 297/228.11, 228.12, 297/228.13
See application file for complete search history.

(56) References Cited

U.S. PATENT DOCUMENTS 1,984,973 A * 12/1934 Krasnov ..... 297/228
2,129,225 A * 9/1938 Mednick ..... 297/228
2,183,828 A * 12/1939 Trubitz ..... 297/224
2,191,633 A * 2/1940 Trubitz ..... 297/228
2,212,485 A * 8/1940 Krasnov ..... 297/224
2,349,193 A * 5/1944 Pass ..... 297/225
2,367,450 A * 1/1945 Trubitz ..... 297/224
2,392,051 A * 1/1946 Lenz ..... 297/225
2,393,543 A * 1/1946 Lenz ..... 297/225
2,411,915 A * 12/1946 Waranch ..... 297/225
2,416,806 A * 3/1947 Waranch ..... 297/225
2,459,328 A * 1/1949 Lenz ..... 297/228
2,469,520 A * 5/1949 Roberts, Jr. ..... 297/225
2,551,214 A * 5/1951 Lenz ..... 297/224
2,556,926 A * 6/1951 Krasnov et al. ..... 297/228
2,589,770 A * 3/1952 Bullinger ..... 297/225 X
2,667,211 A * 1/1954 Krasnov et al. ..... 297/224
2,671,499 A * 3/1954 Reavis et al. ..... 297/225 X
2,757,718 A * 8/1956 Lenz ..... 297/228
RE24,221 E * 9/1956 Waranch ..... 297/228
RE24,279 E * 2/1957 Schutte et al. ..... 297/229 X (Continued)

FOREIGN PATENT DOCUMENTS

FR 2690322 A1 * 10/1993

OTHER PUBLICATIONS

Pottery Barn Reversible Slipcover, p. 13 of catalog.

*Primary Examiner*—Rodney B. White
(74) *Attorney, Agent, or Firm*—Darby & Darby P.C.

(57) ABSTRACT

A reversible slipcover for a piece of furniture including a base, a back, first and second arms, and a seat portion. The reversible slipcover includes a back, two back ruffles sewn to be substantially parallel to one another and to respective sides of the back such that same fabric sides of the two ruffles match same respective fabric sides of the back, a center belt loop located between the two ruffles, and a reversible elastic with end tabs for securing the slipcover to the furniture. The elastic with end tabs traverses between the two back ruffles through the center belt loop and is secured to buttons attached to the slipcover at respective back corners such that the fabric of the end tabs coordinates with the visible side of the reversible slipcover fabric.

9 Claims, 10 Drawing Sheets

U.S. PATENT DOCUMENTS 2,811,198 A * 10/1957 Krogh ..... 297/225
2,820,510 A * 1/1958 Sugarman ..... 297/228
2,828,812 A * 4/1958 Buford ..... 297/228
2,839,127 A * 6/1958 Schutte ..... 297/224
2,871,924 A * 2/1959 Turbitt ..... 297/228
2,877,832 A * 3/1959 Reavis ..... 297/228
2,884,993 A * 5/1959 Schutte ..... 297/229 X
2,921,625 A * 1/1960 Krasnov et al. ..... 297/224
3,116,953 A * 1/1964 Sugarman ..... 297/225
3,195,950 A * 7/1965 Mednick ..... 297/229 X
5,664,831 A * 9/1997 White et al. ..... 297/225
5,664,832 A * 9/1997 Stevens et al. ..... 297/225
5,690,380 A * 11/1997 Waters ..... 297/225
5,733,002 A * 3/1998 Riley et al. ..... 297/224
6,116,685 A * 9/2000 White et al. ..... 297/225 X
6,398,301 B1 * 6/2002 Illulian ..... 297/228
6,409,264 B1 * 6/2002 Palmer et al. ..... 297/225 X
6,659,550 B2 * 12/2003 Hackett ..... 297/228
6,709,054 B2 * 3/2004 Riley et al. ..... 297/228
6,796,609 B2 * 9/2004 Illulian ..... 297/225 X
6,827,398 B2 * 12/2004 Nazginov ..... 297/228
6,832,812 B2 * 12/2004 Riley et al. ..... 297/228
2006/0071520 A1 * 4/2006 Miller ..... 297/225
2006/0250003 A1 * 11/2006 Baines et al. ..... 297/224

* cited by examiner

REVERSIBLE SLIPCOVER

FIELD OF THE INVENTION

The present invention relates to a slipcover for a piece of seating-type furniture, such as a chair, loveseat or sofa, and in particular to a reversible slipcover, including reversible separate seat cushion covers, which adjusts to semi-custom fit furniture of varying sizes.

BACKGROUND OF THE INVENTION

Slipcovers are widely used by consumers as an inexpensive alternative to re-upholstering a piece of seating-type furniture. Originally, slipcovers were custom tailored by a professional having the proper tools and training to precisely fit a particular piece of furniture. Custom tailored slipcovers, however, are typically as expensive as the cost of re-upholstering the piece of furniture.

Prefabricated slipcovers that can fit a variety of furniture items of typical dimensions and which can be more readily applied by the consumer have been designed. Though these slipcovers tend to be less expensive to produce than custom-tailored ones, they can be difficult to design to accommodate various styles and shapes of furniture, and often result in an unsatisfactory appearance due to improper fit.

BRIEF SUMMARY OF THE INVENTION

It is an object of the invention to provide a reversible slipcover that accommodates various styles and shapes of furniture and yet still provides a good fit.

The reversible slipcover of the present invention includes a back, two back ruffles sewn to be substantially parallel to one another and to respective sides of the back such that same fabric sides of the two ruffles match same respective fabric sides of the back, a center belt loop sandwiched between the two ruffles, and a reversible elastic with end tabs for securing the slipcover to the furniture. The elastic with end tabs traverses between the two back ruffles through the center belt loop and is secured to buttons attached to the slipcover at respective back corners such that the fabric of the end tabs coordinates with the visible side of the reversible slipcover fabric.

BRIEF DESCRIPTION OF THE DRAWINGS

The foregoing and other features of the present invention will be more readily apparent from the following detailed description and drawings of illustrative embodiments of the invention, wherein like reference numerals delineate similar elements throughout the several views. In the drawings.

DETAILED DESCRIPTION OF CERTAIN EMBODIMENTS OF THE INVENTION

Figure 1:
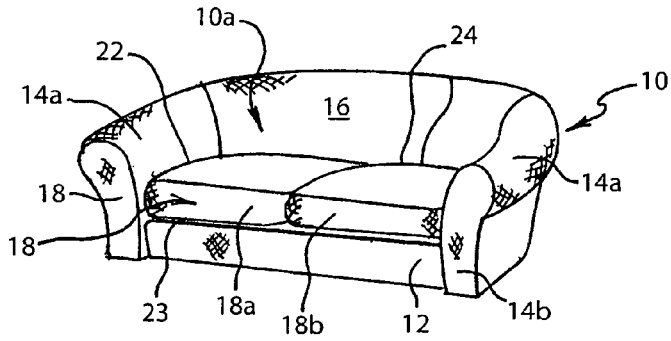
FIG. 1 PRIOR ART
FIG. 1 is a perspective view of a front side of a conventional item of seating-type furniture, in the form of a sofa.
Figure 2:
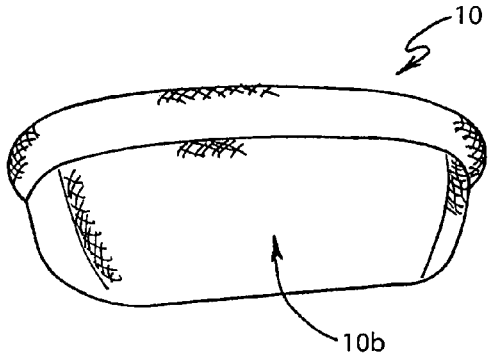
FIG. 2 PRIOR ART
FIG. 2 is a view of the rear side of the item of seating-type furniture illustrated in FIG. 1.

FIGS. 1 and 2 illustrate a typical item of seating-type furniture 10, which for purposes of this example, is a seat in the form of a sofa. It will be noted, however, that slipcovers according to the present invention may be used in combination with any of a variety of types of seating-type furniture having a base, a back, and at least one seat cushion, e.g., club chairs, sofabeds, and the like, though a seat cushion is not necessarily required. FIG. 1 illustrates the front side 10*a* (i.e., the seated side) of the sofa 10, while FIG. 2 illustrates the rear side 10*b* of the sofa. The sofa includes a seat base 12, which is typically somewhat rigid so that it can support the rest of the furniture body and things which may be positioned thereon, such as a person (not shown). The base 12 can be of a variety of shapes, and may include supplemental legs (not shown) or the like.

The sofa 10 preferably includes first and second arms 14 (which include arm sides 14*a* and arm fronts 14*b*), which extend upwardly from opposite ends of the base 12, and are connected to each other by way of a sofa back 16. The back 16 is illustrated as being relatively smooth and continuous, though it is noted that any of a variety of shaped sofas could also be used in combination with a slipcover according to the present invention. For example, the back 16 of the sofa 10 to be covered can be of the conventional camel back shape, or the like.

A cushioned region 18 extends substantially horizontally across the sofa base 12, to provide a sitting surface for a user of the sofa 10. In the illustrated embodiment, the cushioned region 18 includes first and second individual seat cushions 18*a*, 18*b*. It is noted, however, that items of furniture usable in combination with slipcovers of the present invention can include a single bench-style cushion or a plurality of cushions. The cushioned region 18 (i.e., individual cushions 18*a*, 18*b*) is preferably separable from the seat base 12.

As explained in further detail below, the reversible slipcover of the present invention is a semi-custom fitted reversible slipcover having separate, semi-custom fit seat cushion covers, which are also reversible. The slipcover is realized via a two-ply ruffle with a center belt loop, which acts as a casing for elastic with end tabs to travel between. The end tabs exit through mock buttonholes and traverse the faces of a pleated area in respective back corners of the furniture. The end tabs are then secured to buttons attached to the slipcover at respective back corners. Upon reversal of the slipcover, the tabs are removed from the buttons and mock buttonholes, and are once again positioned to traverse the faces of the pleated areas by entering and exiting the mock buttonholes and being attached to the buttons. The face and back of the fabric are visually interchangeable due to felled seams and two-sided zipper pulls for the separate seat cushion application, whereby the customer may choose various decorating options. The result is a slipcover that is easily applied with semi-custom fitted results, minimal closures, and low maintenance.

The slipcover of the present invention can accommodate different furniture sizes via pleated areas having elastic running therethrough and/or using a split arm with modified wrap skirt function, as described in copending application having Ser. No. 11/245,791, which was filed on Oct. 6, 2005, and is incorporated herein by reference in its entirety. It is to be noted, however, that the slipcover of the present invention is not limited to these design features.

A slipcover according to the present invention is shown generally at 30 in FIGS. 3A-3B, 4A and 4B, and 5A-5Z.

Figure 3A:
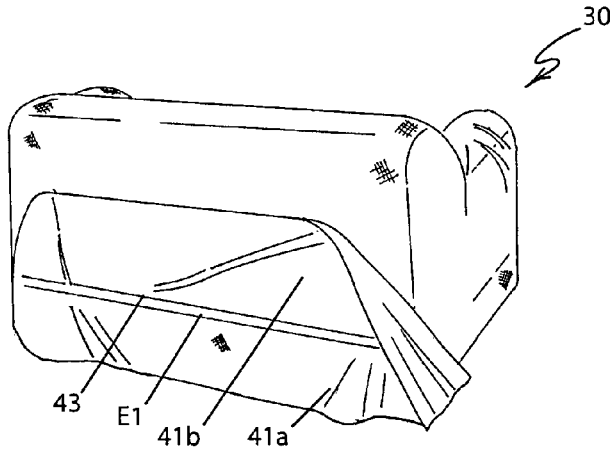
FIGS. 3A-3B are perspective views of portions a slipcover according to the present invention applied to the seating-type furniture illustrated in FIG. 1.
Figure 3B:
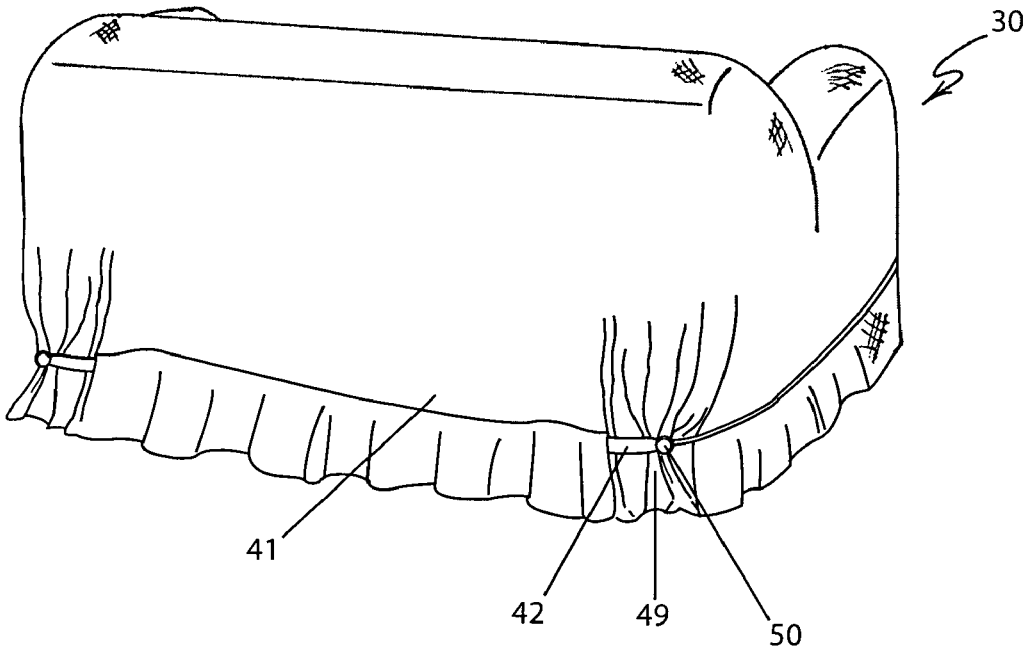
Figure 4A:
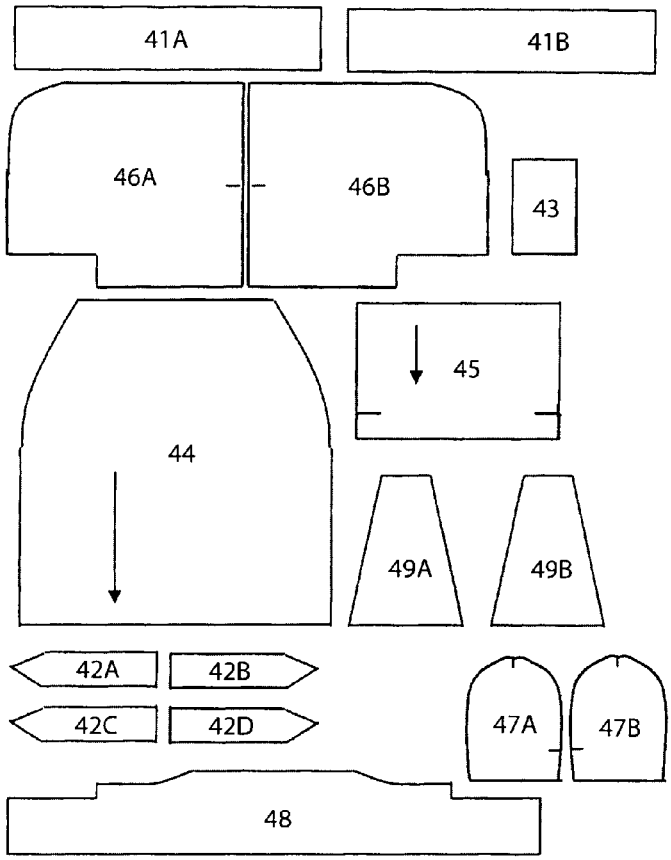
FIGS. 4A-4C are plan views of the pattern components of the reversible slipcover according to the present invention.
Figure 4B:
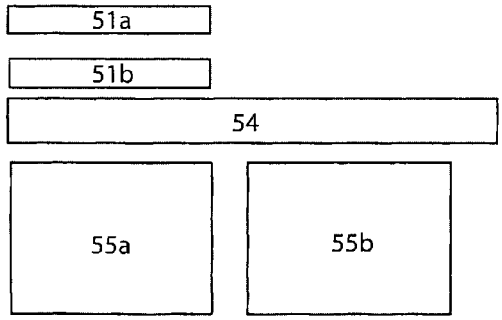
Figure 4C:
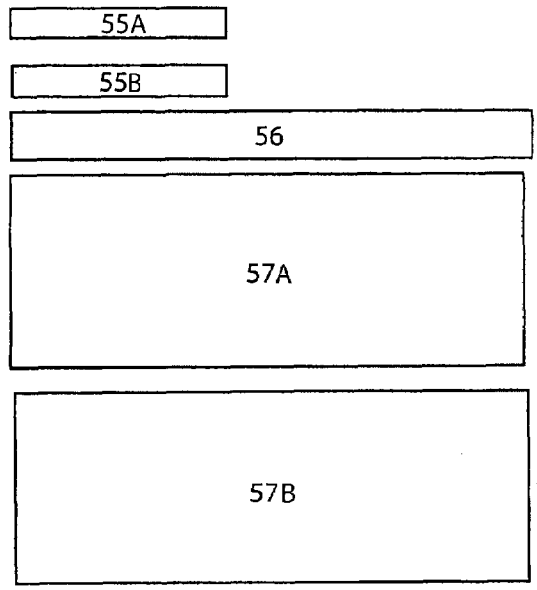

FIGS. 3A-3B illustrate portions of the slipcover 30 applied to the sofa 10 depicted in FIGS. 1 and 2, FIGS. 4A-4C illustrate pattern components of the slipcover 30 of FIGS. 3A-3B, and FIGS. 5A-5Z illustrate a sewing sequence for assembling the pattern components of FIGS. 4A-4C to manufacture the slipcover 30 of FIGS. 3A-3B.

FIGS. 3A-3B illustrate portions of the slipcover 30 applied to the sofa 10 illustrated in FIGS. 1 and 2. As shown in FIG. 3A, the slipcover 30 is realized via a two-ply ruffle 41A, 41B with a center belt loop 43, which acts as a casing for elastic E1 with end tabs 42 to travel between. The end tabs 42 exit through mock buttonholes 41Ac, 41Bc, 41Ad, 41Bd and traverse faces of pleated areas 49 in respective back corners of the furniture. The end tabs 42 are then secured to buttons 50A and 50B attached to the slipcover at the respective back corners. Upon reversal of the slipcover, the tabs 42 are removed from the buttons 50A and 50B and mock buttonholes 41Ac, 41Bc, 41Ad, 41Bd, and are once again positioned to traverse the faces of the pleated areas 49 by entering and exiting the mock buttonholes and being attached to the buttons 50C and 50D, which are located on respective back corners of the slipcover, but on the opposite side of the fabric from buttons 50A and 50B. The face and back of the fabric of the slipcover and separate seat cushion (s) (not shown) are visually interchangeable due to felled seams and two-sided zipper pulls for the seat cushion(s), whereby the customer may choose various decorating options. The result is a slipcover that is easily applied with semi-custom fitted results, minimal closures, and low maintenance.

FIG. 4A shows pattern components for the slipcover. The pattern components include back ruffles 41A, 41B, end tabs 42A, 42B, 42C, 42D, a belt loop 43, a back 44, a seat 45, arm sides 46A, 46B, arm fronts 47A, 47B, front ruffle 48, and pleats 49A, 49B. More specifically, the back 44 is similar to a gumdrop in shape, but with a flat upper portion. The pleats 49A, 49B are each substantially trapezoidal in shape. The arm sides 46A, 46B are each essentially square or rectangular in shape, but with a curved upper right hand corner and a cut-out portion in the lower right-hand corner for one of the arm sides and the mirror image for the other of the arm sides. The arm fronts 47A, 47B are each shaped like a gum drop. The back ruffles 41A, 41B, the belt loop 43, and the seat 45 are each rectangular in shape. The front ruffle is substantially rectangular, but with a projection centered in the center of one its longer sides.

FIG. 4B shows pattern components for cushions of a chair. The pattern components include two zipper bands 51A, 51B, a band 54, a cushion front 55A, and a cushion back 55B. The two zipper bands 51A, 51B and the band 54 are each essentially rectangular in shape. The cushion front 55A and the cushion back 55B are each essentially square in shape.

FIG. 4C shows pattern components for cushions of a sofa or love seat. The pattern components include two zipper bands 55A, 55B, a band 56, a bench cushion front 57A, and a bench cushion back 57B. Each of these components is essentially rectangular in shape.

While specific shapes of the pattern components shown in FIGS. 4A-4C have been described, it is understood that modifications to the shapes and/or sizes of these pattern components may be made without departing form the spirit and scope of the invention, provided the components are still suitable for their intended purpose.

The process for assembling the pattern components of FIG. 4A to manufacture the reversible slipcover of the present invention will now be described with reference to FIGS. 5A-5S. In these figures, as in the other figures, the dotted lines denote sewing lines, and the arrows denote fabric direction.

Figure 5A:
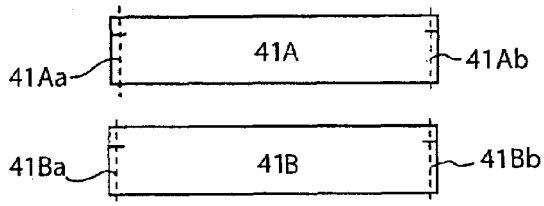
FIGS. 5A-5Z are plan views illustrating a sewing sequence for assembling the pattern components of FIGS. 4A and 4B to manufacture the reversible slipcover according to the present invention.

Referring to FIG. 5A, the face-up side of the back ruffle 41A is edged along seams 41Aa and 41Ab. The face-down side of the back ruffle 41B is edged along seams 41Ba and 41Bb.

Figure 5B:
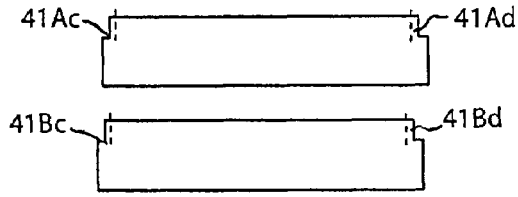

As shown in FIG. 5B, each of the top corners of the back ruffle 41A is hemmed to create notches 41Ac and 41Ad. Similarly, each of the top corners of the back ruffle 41B are hemmed to create notches 41Bc and 41Bd.

Figure 5C:
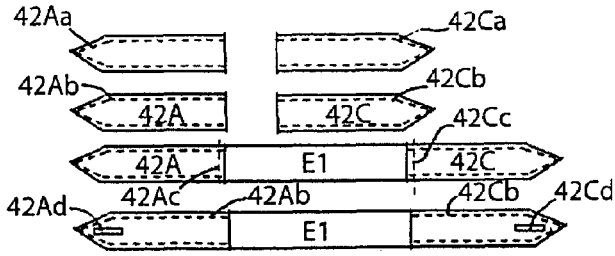

FIG. 5C illustrates the end tabs 42 being attached to elastic E1. More specifically, the end tabs 42A and 42B (not shown) are placed with opposing fabric sides facing one another and stitched along seam 42Aa. These end tabs 42A, 42B are then turned and topstitched along seam 42Ab, such that the face of the fabric is on one side, and the back of the fabric is shown on the opposing side. Similarly the end tabs 42C and 42D (not shown) are placed with opposing fabric side facing one another and stitched along seam 42Ca. These end tabs 42C, 42D are then turned and topstitched along seam 42Cb, such that the face of the fabric is shown on one side, and the back of the fabric is shown on the other side. Next, elastic E1 is inserted into ends of each of the end tabs 42A/42B and 42C/42D and stitched along seams 42Ac and 42Cc, respectively. Finally, a buttonhole 42Ad is created at the end of end tabs 42A/42B, and similarly, a buttonhole 42Cd is created at the end of end tabs 42C/42D.

Figure 5D:
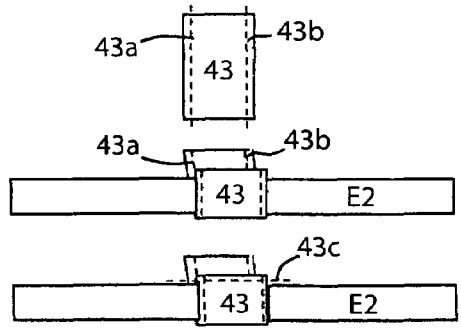

Referring now to FIG. 5D, the sides of the belt loop 43 are hemmed along seams 43*a* and 43*b*. The hemmed belt loop 43 is then folded around an elastic E2 and stitched along seam 43*c*.

Figure 5E:
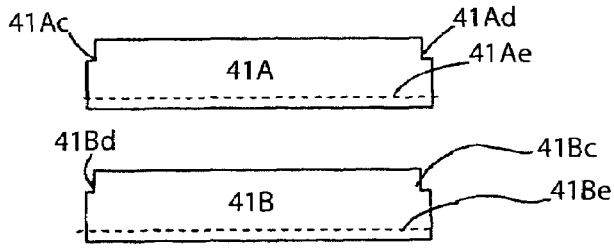
Figure 5F:
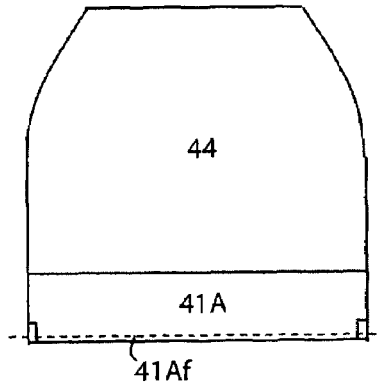
Figure 5G:
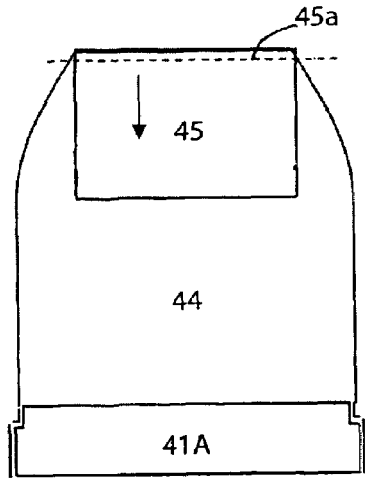

As shown in FIG. 5E, back ruffle 41A is hemmed along seam 41Ae in a double roll. Similarly, back ruffle 41B is hemmed along seam 41Be in a double roll. Next, as shown in FIG. 5F, the back 44 is sandwiched between the back ruffles 41A, 41B (not shown), such that same sides of the ruffles 41A, 41B made same respective sides of the back 44, and the back ruffles 41A, 41B are sewn to the back 44 along seam 41Af. Then, as shown in FIG. 5G, the seat 45 is set to the back 44 and sewn in a french seam along seam 45*a* to close raw edges inside the seam.

Figure 5H:
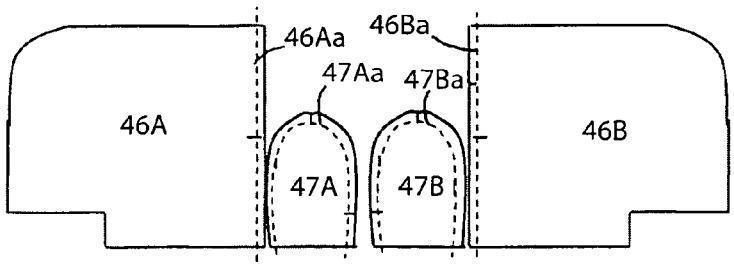
Figure 5I:
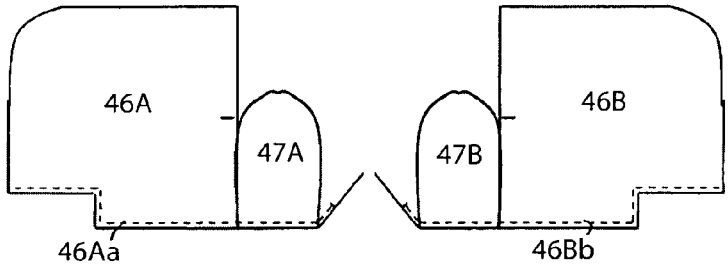

FIG. 5H illustrates the construction of the arms. The arm front 47A is set to the arm side 46A face-to-face. The arm front 47A is then turned and topstitched along seams 47Aa and 46Aa with a seam allowance enclosed inside the topstitch. Similarly, the arm front 47B is set to the arm side 46B face-to-face. The arm front 47B is then turned and topstitched along seams 47Ba and 46Ba with a seam allowance enclosed inside the topstitch. Then, as shown in FIG. 5I, the arms sides 46A, 46B and arm fronts 47A, 47B are edged from seat notch (Brenda, where is this seat notch?) across the arm front 47A and the arm side 46A along seam 46Ab, and across the arm front 47B and the arm side 46B along seam 46Bb.

Figure 5J:
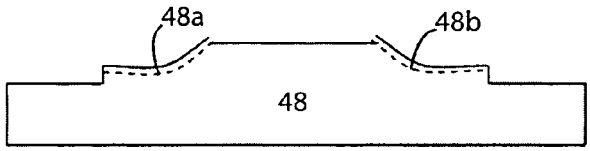
Figure 5K:
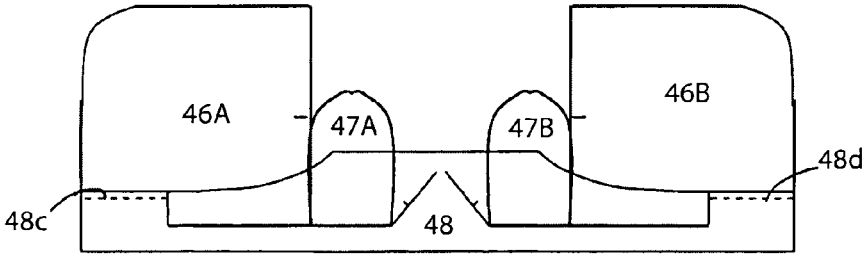
Figure 5L:
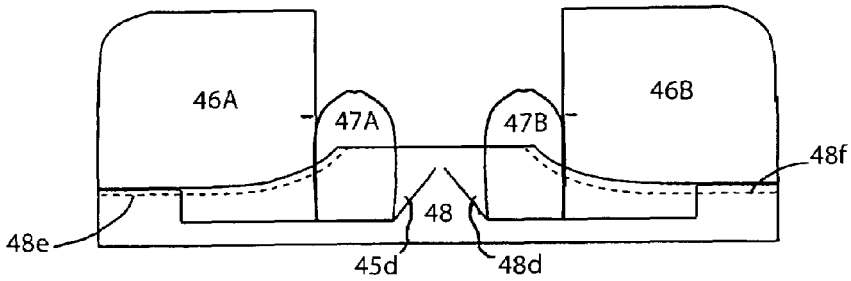

Referring now to FIG. 5J, the front ruffle 48 is clean finished face-up along seams 48*a* and 48*b* with a double roll hem. The front ruffle 48 is then set to the arm sides 46A, 46B face to face and sewn along seams 48*c* and 48*d*, respectively, in a French seam. Next, as shown in FIG. 5L, the front ruffle 48 is topstitched along seams 48*e* and 48*f* to seat notches 45*d*.

Figure 5M:
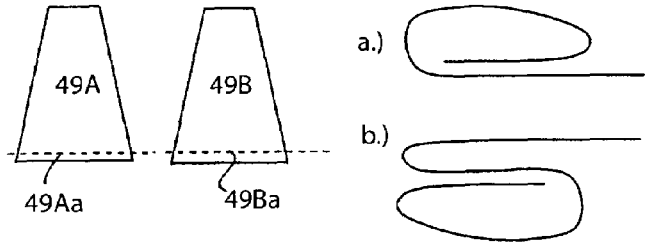
Figure 5N:
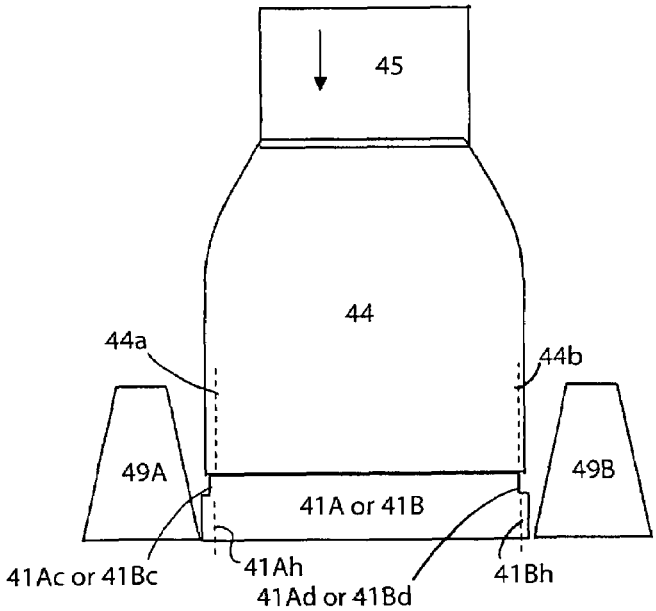
Figure 5O:
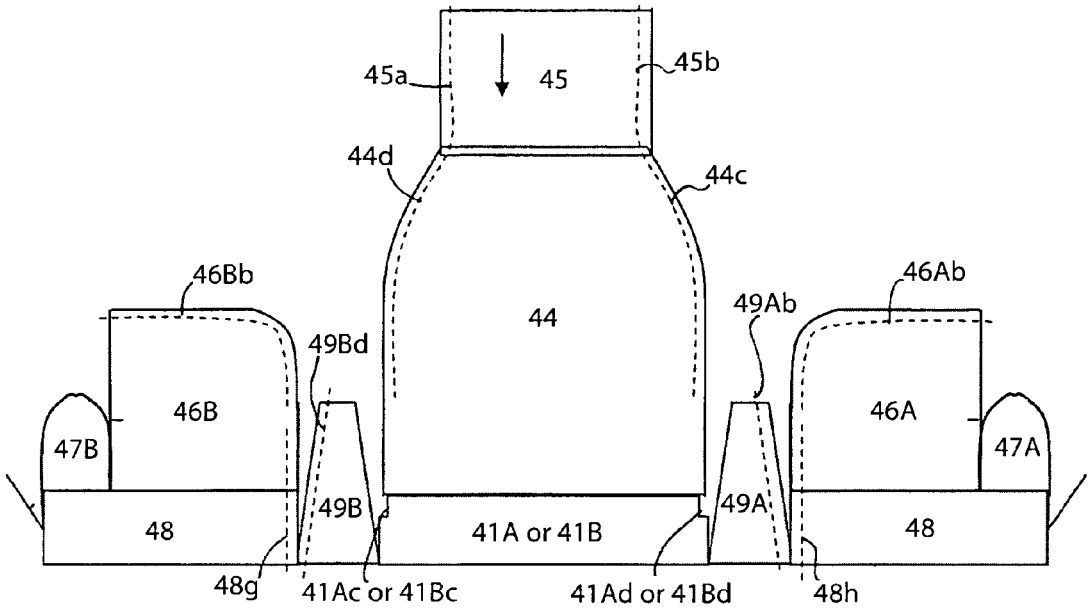

FIG. 5M illustrates the formation of the corner pleats 49A, 49B. Each of the corner pleats 49A, 49B is first hemmed along seams 49Aa and 49Ba, respectively. Then, each of the corner pleats 49A, 49B is hemmed in a double roll (see diagram "a)"), and rolled back to face and stitch through (see diagram "b)"). As shown in FIG. 5N, the pleats 49A, 49B are then set to the back 44 and topstitched along seams 41Ah and 44*a*, and along seams 41Gh and 44*b*, leaving mock buttonholes 41Ac, 41Bc and 41Ad, 41Bd open.

Referring to FIG. 50, the pleat 49A is sewn to the front ruffle 48 along seam 48*h* and a portion of 49Ab and to arm side 46A along a portion of seam 46Ab and the remainder of seam 49Ab, and the back 44 and seat 45 are sewn along seams 44*c* and 45*b* to the remainder of seam 46Ab, pleating at the notch 41Ad or 41Bd. Similarly, the pleat 49B is sewn to the front ruffle 48 along seam 48*g* and a portion of 49Bb and to arm side 46B along a portion of seam 46Bb and the remainder of seam 49Bb, and the back 44 and seat 45 are sewn along seams 44*d* and 45*c* to the remainder of seam 46Bb, pleating at the notch 41Ac or 41Bc. Next, the fabric components are turned to topstitch along the seams so raw edges are enclosed inside the seams.

Figure 5P:
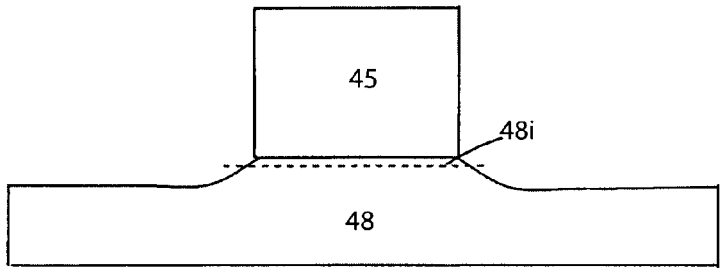
Figure 5Q:
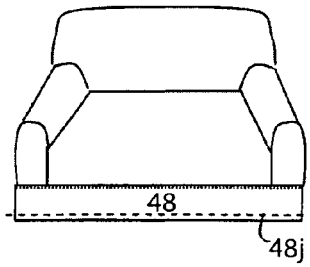

Turning to FIG. 5P, the front ruffle 48 is set to the seat 45 face-to-face and sewn along seam 48*i* in a french seam. As shown in FIG. 5Q, the front ruffle 48 is hemmed along seam 48*j* along its inside.

Figure 5R:
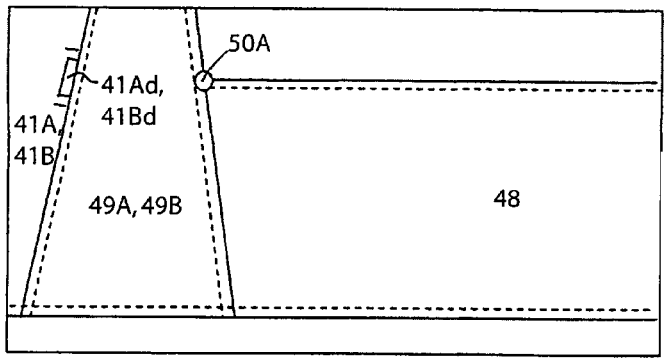
Figure 5S:
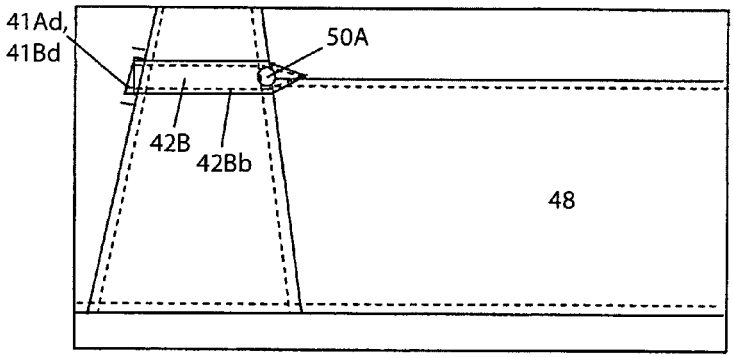

Referring now to FIG. 5R, a button 50A and 50B (only 50A shown) is sewn to the top of each side of the intersections of pleats 49A and 49B and front ruffle 48, with four buttons 50A, 50B, 50C, 50D in total. One tab 42 of the elastic band E1 with end tabs 42 travels through mock buttonhole 41Ad/41Bd, traverses the face of corner pleat 49A, and the buttonhole 42Ad attaches to a respective button 50A. Similarly, the other end tab 42 travels through mock buttonhole 41Cd/41Dd, traverses the face of corner pleat 49B, and the buttonhole 42Cd attaches to another respective button 50B.

The process for assembling the pattern components of FIG. 4B to manufacture the reversible seat cover of the chair of the present invention will now be described with reference to FIGS. 5T-5Z.

Figure 5T:
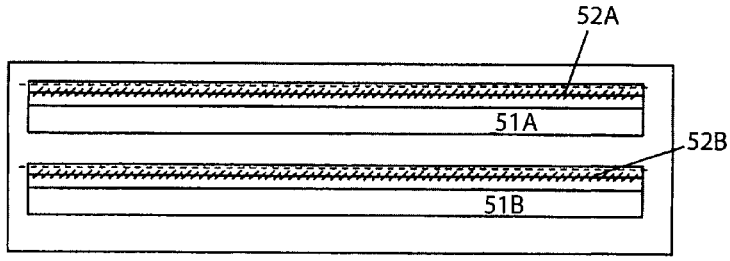
Figure 5U:
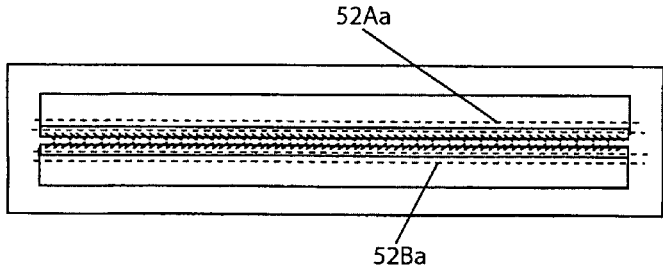
Figure 5V:
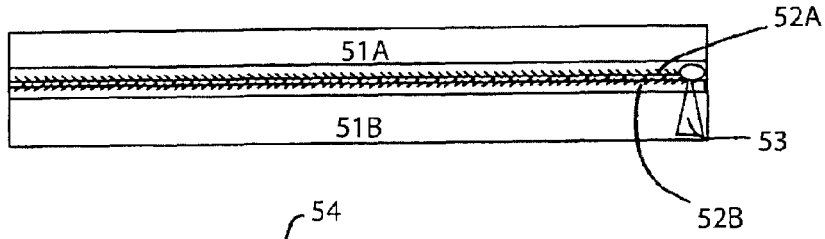

Referring to FIG. 5T, zipper halves 52A and 52B (which together create zipper 52) are sewn to zipper bands 51A, 52B, respectively. Then, as shown in FIG. 5U, a double needle set binding is sewn over the zipper raw edges along seams 52Aa and 52Ba. A zipper pull 53 is then added, as shown in FIG. 5V.

Figure 5W:
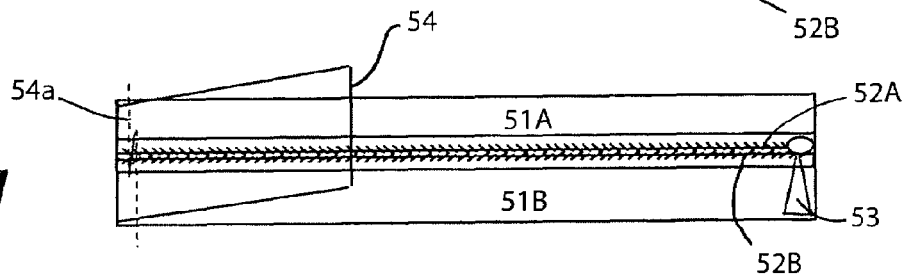
Figure 5X:
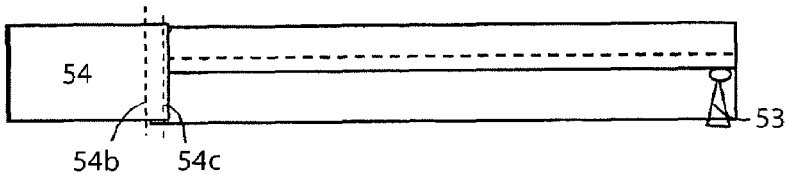
Figure 5Y:
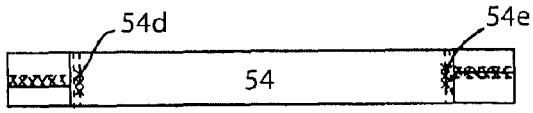

Referring now to FIG. 5W, the band 54 is joined to the zipper 52 and zipper bands 51A, 51B face-to-face by sewing along seam 54*a*. Then, as shown in FIG. 5X, the zipper 52 and zipper band 51 combination is topstitched along seams 54*b* and 54*c* to enclose raw edges inside the seam. The, as shown in FIG. 5Y, the zipper chain is bartacked at 54*d* and 54*e*.

Figure 5Z:
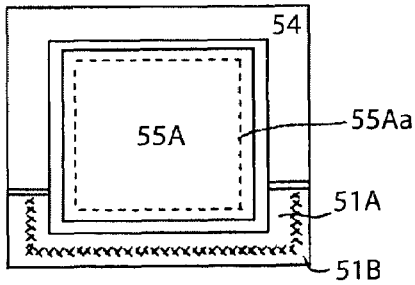

Finally, as shown in FIG. 5Z, the combination of the band 54, the zipper 52, and the zipper band 51 is sewn to the cushion front 55A along seam 55Aa and to the cushion back 55B, and then the combination of patterns is turned and topstitched to enclose raw edges.

Some the seams made be sewn using felled seams so as to made the seams more visually pleasing for reversal of the slipcover fabric. For example, some of the seams that may be sewn using felled seams include but are not limited to the attachment of the arm fronts 47A, 47B to the arm sides 46A, 46B, the attachment of the back 44 with the back ruffles 41A, 41B, and the attachment of the corner pleats 49A, 49B and arm sides 46A, 46B with the front ruffle 48.

The process for assembling the pattern components of FIG. 4C to manufacture the reversible seat cover of the loveseat or sofa of the present invention is similar to that just described for the pattern components of FIG. 4B for the chair, except that zipper bands 55A, 55B are used in place of zipper bands 51A, 51B, band 56 is used in place of band 54, bench cushion front 57A is used in place of cushion front 55A, and bench cushion back 57B is used in place of cushion back 55B. The detailed description of the assembly process of the seat cover for the loveseat and sofa is similar to that of the chair, and thus a detailed description is unnecessary and omitted.

As discussed above, a significant feature of the slipcover of the present invention is the ability of the slipcover and the cushion(s) to be reversed, and in any combination. This feature is accomplished through a two-ply ruffle with a center belt loop, which acts as a casing for a reversible elastic with end tabs to travel between, and the end tabs are secured to buttons attached to the slipcover at respective back corners. The face and back of the fabric are visually interchangeable due to felled seams and two-sided zipper pulls for the separate seat cushion application, whereby the customer may choose various decorating options.

The slipcover may be made from any of a variety of materials or fabrics, such as typical upholstery-type fabrics or plastic materials. The elastic may be secured to the slipcover covering using any conventional securement method, such as sewing or adhesive bonding. Where the slipcover is formed from a thermoplastic material, the elastic may be ultrasonically welded to the slipcover portions, using conventional techniques.

Also, while the slipcover has been described as being applicable to a chair, loveseat, or sofa, it is understood that the slipcover may be applied to any seating-type furniture having a base, a back, and generally a seat cushion, though a seat cushion is not a requirement.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A reversible slipcover for a piece of furniture including a base, a back, first and second arms, and a seat portion, the reversible slipcover comprising:

a back portion having opposing fabric sides;

two back ruffles sewn to the back portion, wherein the two back ruffles are substantially parallel to one another and to respective sides of the back portion, wherein the two back ruffles are substantially overlapping and wherein a fabric side of each of the two ruffles is matched to a respective fabric side of the back portion;

a center belt loop located between the two ruffles; and a reversible elastic with end tabs for securing the slipcover to the furniture, wherein the elastic with end tabs traverses between the two back ruffles through the center belt loop, each end tab including an aperture for securing the end tab to either of a pair of buttons attached to opposing fabric sides at respective back corners of the slipcover such that fabric sides of the end tabs coordinate with a visible side of the reversible slipcover fabric.

2. The reversible slipcover of claim 1, wherein after the elastic with end tabs traverses between the two back ruffles through the center belt loop, the end tabs exit through respective mock buttonholes, and traverse faces of pleated areas at the respective back corners of the slipcover when secured to the buttons.

3. The reversible slipcover of claim 1, wherein seams of the slipcover are felled seams.

4. The reversible slipcover of claim 1, further comprising at least one reversible seat cushion cover having a two-sided zipper pull.

5. A combination comprising:

a piece of furniture including a base, a back, first and second arms, and at least one seat cushion; and a slipcover comprising:

a back portion having opposing fabric sides;

two back ruffles sewn to the back portion, wherein the two back ruffles are substantially parallel to one another and to respective sides of the back portion, wherein the two back ruffles are substantially overlapping and wherein a fabric side of each of the two ruffles is matched to a respective fabric side of the back portion;

a center belt loop located between the two ruffles; and a reversible elastic with end tabs for securing the slipcover to the furniture, wherein the elastic with end tabs traverses between the two back ruffles through the center belt loop, each end tab including an aperture for securing the end tab to either of a pair of buttons attached to opposing fabric sides at respective back corners of the slipcover such that fabric sides of the end tabs coordinate with a visible side of the reversible slipcover fabric.

6. The combination of claim 5, wherein after the elastic with end tabs traverses between the two back ruffles through the center belt loop, the end tabs exit through respective mock buttonholes, and traverse faces of pleated areas at the respective back corners of the slipcover when secured to the buttons.

7. The combination of claim 5, wherein seams of the slipcover are felled seams.

8. The combination of claim 1, further comprising at least one reversible seat cushion cover having a two-sided zipper pull.

9. A reversible slipcover for a piece of furniture including a base, a back, first and second arms, and a seat portion, the slipcover comprising:

a back portion having opposing fabric sides;

two back ruffles sewn to the back portion, wherein the two back ruffles are substantially parallel to one another and to respective sides of the back portion, wherein the two back ruffles are substantially overlapping and wherein a fabric side of each of the two ruffles is matched to a respective fabric side of the back portion;

a center belt loop located between the two ruffles; and a reversible elastic with end tab means for securing the slipcover to the furniture, wherein the elastic with end tab means traverses between the two back ruffles through the center belt loop, each end tab means including an aperture for securing the end tab means to either of a pair of buttons attached to opposing fabric sides at respective back corners of the slipcover such that fabric sides of the end tab means coordinate with a visible side of the reversible slipcover fabric.

* * * * *